US007438678B2

(12) United States Patent
Beyer

(10) Patent No.: US 7,438,678 B2
(45) Date of Patent: Oct. 21, 2008

(54) FULL JACKET HELICAL CONVEYOR CENTRIFUGE WITH ELECTROMAGNETIC DIRECT DRIVE

(75) Inventor: Hans-Joachim Beyer, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 276 days.

(21) Appl. No.: 10/565,756

(22) PCT Filed: Jul. 21, 2004

(86) PCT No.: PCT/EP2004/008154

§ 371 (c)(1),
(2), (4) Date: Jan. 24, 2006

(87) PCT Pub. No.: WO2005/011871

PCT Pub. Date: Feb. 10, 2005

(65) Prior Publication Data

US 2006/0183621 A1 Aug. 17, 2006

(30) Foreign Application Priority Data

Jul. 25, 2003 (DE) ..... 103 34 370

(51) Int. Cl.
*B04B 1/20* (2006.01)
*B04B 9/04* (2006.01)

(52) U.S. Cl. ..... 494/53; 494/84

(58) Field of Classification Search ..... 494/7–9, 494/50–54, 84; 210/380.1, 380.3; 310/156.01, 310/156.08, 156.11
See application file for complete search history.

(56) References Cited

U.S. PATENT DOCUMENTS

| | | | | |
|---|---|---|---|---|
| 4,299,353 | A | 11/1981 | Bruning et al. | |
| 5,084,133 | A | 1/1992 | Guy et al. | |
| 5,714,858 | A * | 2/1998 | Pieralisi | 318/539 |
| 6,280,375 | B1 | 8/2001 | Meisberger et al. | |
| 7,041,044 | B2 * | 5/2006 | Gilbert | 494/53 |
| 2006/0014619 | A1 * | 1/2006 | Haider | 494/53 |
| 2006/0183621 | A1 * | 8/2006 | Beyer | 494/53 |

FOREIGN PATENT DOCUMENTS

| | | | |
|---|---|---|---|
| DE | 1 732 887 | | 6/1956 |
| DE | 74 26 632 | | 4/1975 |
| DE | 28 11 887 | A1 | 9/1979 |
| DE | 33 25 566 | A1 | 1/1985 |
| DE | 3325566 | A1 * | 1/1985 |
| DE | 34 07 593 | A1 | 9/1985 |
| DE | 38 34 222 | A1 | 4/1990 |
| DE | 40 08 945 | A1 | 9/1990 |
| EP | 0 930 099 | B1 | 7/1999 |
| WO | WO 2005011871 | A1 * | 2/2005 |

* cited by examiner

*Primary Examiner*—Charles E Cooley
(74) *Attorney, Agent, or Firm*—Barnes & Thornburg LLP

(57) ABSTRACT

A full-jacket helical conveyor centrifuge including a rotatably disposed drum and a drive device for the drum. The drive device for the drum includes at least one electromechanical direct drive having secondary elements arranged on the outer periphery of the drum or on the outer periphery of a part non-rotatably connected with the drum. Primary elements are arranged radially outside the secondary elements at a distance from the secondary elements and without contact. A propulsion force is generated by an electromagnetic field of travelling waves.

19 Claims, 1 Drawing Sheet

FULL JACKET HELICAL CONVEYOR CENTRIFUGE WITH ELECTROMAGNETIC DIRECT DRIVE

BACKGROUND AND SUMMARY

The present disclosure relates to a full-jacket helical conveyor centrifuge including a rotatably disposed, metallic drum with a horizontal axis of rotation. Also included is at least one drive device for the drum. A helical conveyor is also included which is rotatably disposed at a differential rotational speed with respect to the rotational speed of the drum. The helical conveyor can be rotated by a gearing by the at least one drive device for the drum or by another device.

It is known to drive centrifuges in many different manners. In the field of full-jacket helical conveyor centrifuges, it has caught on to equip the helical conveyor and the drum respectively with a driving device in order to be able to control these two elements separately from one another without any tie to a fixed transmission ratio. Such a state of the art is known from German Patent Document DE-A-2811887 or DE 1732887.

For driving the drum, a belt drive is generally used which has been successful in practice but which requires a relatively large amount of space and therefore, because of frictional heat in the event of a belt slip, generates high temperature at the belts and the pulleys and is also often relatively loud. A demand therefore exists for alternative drive concepts where a belt drive is avoided.

For example, in the case of laboratory centrifuges, electromagnetic drives are also known; such as magnets in a rotating beaker glass. Furthermore, from European Patent Document EP 0 930 099 B1, an electromagnetic transmission for driving a laboratory centrifuge is known which is connected behind an electric motor but which is not suitable for larger centrifuges, such as full-jacket helical conveyer centrifuges. A spinning centrifuge in the manner of a magnetic drive is also illustrated in German Patent Document DE 74 26 623 U1.

The use of an axial-field electric motor in the case of a sugar drum-type centrifuge without a helical conveyor is also known from German Patent Document DE 33 25 566 C2. In contrast, a use on a full-jacket helical conveyor centrifuge has so far not been considered, probably because this type of centrifuge always also requires a drive for the helical conveyor and because an excessive heating of the product by way of the drum was also feared. An analogous situation applies to the solutions of German Patent Document DE 40 08 945 C2, which shows an evaporator—concentrator centrifuge, and German Patent Document DE 38 34 222 C2.

The present disclosure relates to a full-jacket helical conveyor centrifuge having a drive as an alternative to a belt drive.

The present disclosure further relates to a full-jacket helical conveyor centrifuge including a rotatably disposed drum and a drive device for the drum. The drive device for the drum includes at least one electromechanical direct drive having secondary elements arranged on the outer periphery of the drum or on the outer periphery of a part non-rotatably connected with the drum. Primary elements are arranged radially outside the secondary elements at a distance from the secondary elements and without contact. A propulsion force is generated by an electromagnetic field of travelling waves.

Accordingly, the drive device for the horizontally disposed drum has at least one electromechanical direct drive, whose primary or secondary elements are arranged directly at or on the drum or whose primary and secondary elements are arranged at or on a part non-rotatably connected with the drum, and whose corresponding secondary or primary elements are arranged at a distance outside the drum or the part non-rotatably connected with the latter with no contact between these. A propulsion force is generated without gears by an electromagnetic field of travelling waves which advances outside the drum around the metallic drum or around the part non-rotatably connected with the latter. This can be implemented, for example, by a large number of successively controllable coils on the outer periphery of the drum which are used as the primary elements for generating the field of travelling waves in order to, in the process, take along a large number of the permanent-magnetic secondary elements.

Thus, a simple concept of a field of travelling waves, which is generated directly without an electric motor on the input side and which advances, for example, on the outer periphery of the drum around the drum and does not penetrate the latter like a rotating field, is utilized also for the direct drive of a centrifugal drum of a decanter with a helical conveyor. According to the present disclosure, the helical conveyor can also be driven in manner different from that of the drum, for example, by a conventional rotating-field electric motor. The problem of the heat development of a product by the drum can also, against all expectations, be controlled in the case of a full-jacket helical conveyor centrifuge. In addition, a continuous rotational speed adjustment can take place without a frequency converter.

A ratio between the inner axial dimension of the drum and its inside diameter is greater than 1, and may be greater than 2.5. For such drums, the "field of travelling waves drive" can be accommodated in an area of the elongated drum without interfering with function elements at the axial ends of the drum.

According to the present disclosure, a belt drive for the drum can be eliminated. Instead, an electromagnetic gearless direct drive is used for the drum, which direct drive has a compact construction while the torque is high and is easily controllable in a low-noise manner. As a result, a safety advantage is also obtained because the drum can be braked particularly rapidly by the direct drive.

The secondary elements of the at least one direct drive are arranged on the outer periphery of the drum or on the outer periphery of a part non-rotatably connected with the drum. The primary elements are arranged radially outside the secondary elements at a distance from these with no mutual contact. By this arrangement, a compact embodiment is implemented and permits the complete elimination of a gear. Disadvantageous axial forces upon the bearing are avoided.

The present disclosure is applicable for a use in the case of full-jacket helical conveyor centrifuges. There are many points of the drum of this type of a centrifuge on which, depending on the performance and constructively geometrical situation, one or more electromagnetic direct-drive devices for the drum can be arranged. The compact arrangement is advantageous here because the drive device can be integrated completely into the decanter frame or the machine frame. Further advantages are the low generating of noise and, under certain circumstances, even vibration-damping characteristics. The forces acting upon the drum bearing which would be applied by a belt drive are eliminated.

It is possible that several of the electromagnetic direct drives may also be arranged on the drum or the part non-rotatably connected with the drum.

The drum itself, particularly its cylindrical section from a constructive point of view, may offer a preferred site of the arrangement of the direct drive. Although a thermal influence affects the drum and the centrifugal material in this area, it generally can be kept low.

If, on the other hand, an attachment is used as an axial extension of the drum for arranging the direct drive, an additional heat development of the product area by the drum is avoided. Nevertheless, a drive directly on the drum between the two main bearings may be preferred, because here also negative loads of the drive upon the main bearings can be largely avoided.

The primary or secondary elements surround the drum completely or in sections concentrically. The arrangement in sections thereby may simplify the constructive expenditures.

It is also conceivable that the primary or secondary elements are arranged on a ring disk projecting radially from the drum or a part non-rotatably connected with this drum. The ring disk is non-rotatably connected with this drum or part, and the corresponding secondary or primary elements are arranged on a non-rotatable ring disk or on a ring, which is arranged, for example, in an axially offset manner parallel to the co-rotating disk.

The present disclosure is applicable to the full-jacket helical conveyor centrifuge such as, the so-called decanter having a helical conveyor, where a belt drive for the drum can be replaced. The helical conveyor can be driven in a different manner; for example, hydraulically or mechanically or by a gearing between the drum and the helical conveyor or by another direct drive with a field of travelling waves arrangement. In this case, a gearing between the drum and the helical conveyor can also be eliminated.

The present disclosure addresses a full-jacket helical conveyor centrifuge with a rotatably disposed metallic drum and a rotatable helical conveyor as well as a drive device for the drum and a drive device for the helical conveyor. At least the drive device for the helical conveyor has at least one electromechanical direct drive whose primary or secondary elements are arranged directly at or on a part non-rotatably connected with the helical conveyor, and whose corresponding secondary or primary elements are arranged without contact at a distance outside this part. A propulsion force being generated without gears by an electromagnetic field of travelling waves advances around the part non-rotatably connected with the helical conveyor. In this manner, a gearing between the drum and the helical conveyor could even be eliminated, so that the two elements can be controlled completely independently of one another. In this case, it may be advantageous to further develop both drives, that is, the drive for the drum and that for the helical conveyor, as a direct drive.

It is conceivable that the drum and/or the helical conveyor have at least one play-free bearing around which or directly adjacent to which the respective electromagnetic direct drive is arranged.

The drive device for the helical conveyor may be constructed independently of the drive device for the drum.

It is conceivable that another co-rotating field of travelling waves motor is included to generate the required differential rotational speed between the helical conveyor and the drum. Should this motor be only to generate the differential rotational speed, it may have small dimensions and therefore be cost-effective.

Other aspects of the present disclosure will become apparent from the following descriptions when considered in conjunction with the accompanying drawings.

DETAILED DESCRIPTION

Figure 1:
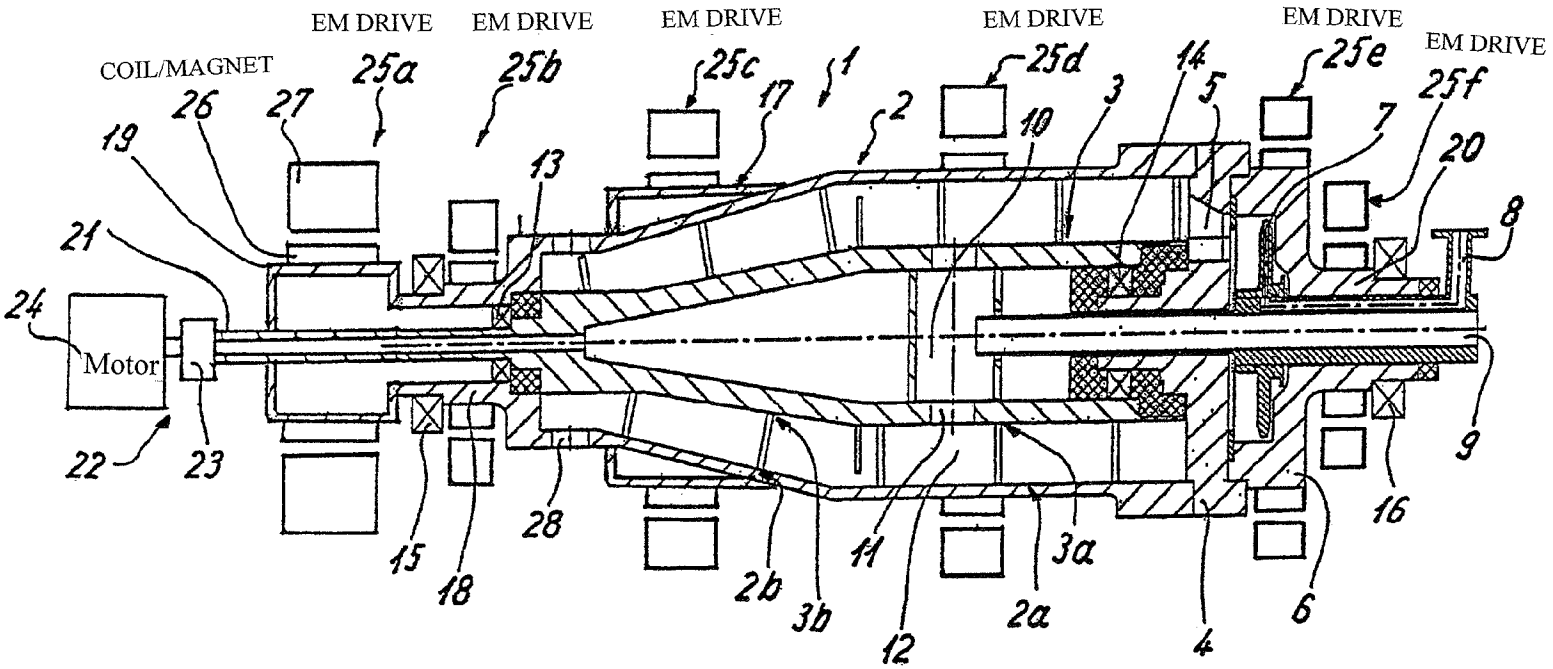
FIG. 1 is a sectional view of a fall-jacket helical conveyor centrifuge including a schematic representation of the drive device for the drum having several alternative arrangements, according to the present disclosure.

FIG. 1 illustrates a full-jacket helical conveyor centrifuge 1 with a rotatably disposed drum 2 and a rotatably disposed helical conveyor 3. The helical conveyor 3 has a differential or different rotational speed with respect to the drum 2 in an operation.

The drum 2, as well as the helical conveyor 3, each have a cylindrical section 2*a*, 3*a* with at least one outlet 5 for a liquid phase as well as a tapering, for example, conical section 2*b*, 3*b* adjoining on one side and having an outlet 28 for a solids phase.

On its cylindrical end, the drum 2 is closed off by a drum lid 4 which has the outlet 5 for the liquid phase, behind which, as an example, a chamber 6 is connected which has a centripetal pump 7 stationary in the operation and, in turn, followed by a discharge 8. Outlet 5 can also be followed by a baffle plate or directly by a discharge (not shown).

An inflow pipe 9 leads axially through the helical conveyor 3 or the helical conveyor body from the cylindrical end of the drum 2 into a distributor 10 which has openings 11 into centrifugal space 12 between the drum 2 and the helical conveyor 3.

Between the drum 2 and the helical conveyor 3, bearings 13, 14 are arranged on both sides of the drum 2. In addition, the drum 2 is disposed at its two axial ends by drum bearings 15, 16 on a machine frame (not shown).

The drum 2 has several parts which are non-rotatably connected with it. These include the chamber 6 for the centripetal pump 7 as well as several cylindrical attachments 17, 18, 19, 20 of the drum 2 which, for example, may be arranged in the axial direction between the main drum bearings 15, 16 or laterally outside the main drum bearings 15, 16 on both axial ends of the drum 2. A ratio between the axial inner dimension of the drum 2 and a maximal inside diameter is greater than 1, and may be greater than 2.5 or greater than or equal to 3. As an axial extension of its conical section 3*b*, the helical conveyor 3 has a shaft 21 which is adjoined by a first drive device 22 for driving the helical conveyor 3. The first drive device 22 comprises a gearing 23 and an electric motor 24.

At least one gearless electromagnetic direct drive 25*a-f* is used as a second drive device or as the drive device for the drum 2. The electromagnetic direct drive 25*a-f* can be arranged at different points of the drum 2 or on a part non-rotatably connected with the drum 2, which, for example, is shown as six drive devices 25*a-f*. As suggested herein, several drive devices may be provided at the drum 2 or on parts non-rotatably connected with the drum 2.

Rotor or secondary elements 26 are arranged on the cylindrical section 2*a* of the drum 2 or on a cylindrical part, for example, parts 6, 17, 18, 19, 20, non-rotatably connected with the elongated drum 2. Primary elements 27 are arranged concentrically with respect to the secondary elements 26 and at a distance to the latter without contact.

At the ends of the drum 2, the discharges for the solids 28 and liquid phases 8, remain free of elements of the drives 25*a-f*.

The primary elements 27 may extend around the entire periphery of the drum 2 or only over a sector of a circle, for example, over a periphery of 90°.

Figure 2:
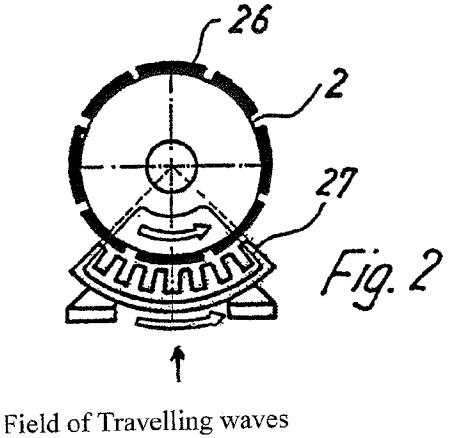
FIG. 2 is a schematic view of a centrifugal drum including a direct drive as a method of operation, according to the present disclosure.

The electromagnetic direct drive 25*a-f* is constructed similarly to an electromagnetic "linear motor". However, the electromagnetic direct drives 25*a-f* are shown here, either completely or in sections, as guided around the drum 2 or the part non-rotatably connected with the drum. A plurality, for example, more than eight, primary elements 27, such as respective coils, are used to construct a magnetic field of travelling waves which virtually travels on the outside around the metallic full-jacket drum 2 and, in the process, takes along a plurality of, for example, more than eight, permanent-magnetic or coil-type secondary elements 26 on the drum 2. This is schematically illustrated in FIG. 2. The primary elements 27 surround the drum 2, in sections or completely, and the secondary elements 26 surround the drum 2 completely.

The secondary elements 26 may be arranged on a cylindrical section 2*a* of the drum 2, in an area of the axial center, for example, see drive 25*d*, of the drum 2, or completely or in sectors around the drum 2 and placed radially on the drum 2.

The cylindrical section 2*a* may be a desired site to place the drive, such as 25*d*. Here, the axial ends of the drum 2 remain free of any of the drive components 25*a-f*, which may simplify the construction of the drive arrangement.

As an alternative, an axial attachment, such as 6, 18, 19, 20, 17 may be used on the drum 2, which attachment 6, 18, 19, 20, 17 may be non-rotatably connected with the drum, and can be utilized for arranging the secondary elements 26. This attachments 6, 18, 19, 20, 17 can be arranged in the axial direction inside or outside the drum bearings 15, 16 as well as as an axial extension of the drum 2 or on the conical section 2*b* of the drum (see attachment 17). Attachment 19 could include a gearing between the helical conveyor 3 and the drum 2.

As an option or alternative, the helical conveyor 3 can also be driven, for example, at the shaft 21 or at an element (not shown) non-rotatably connected with the shaft 21 by a separate additional direct drive (not shown) in the manner of a direct drive for the drum 2. Thus, even a gearing between the drum 2 and the helical conveyor 3 could be eliminated.

By a control unit, (not shown) and which has no frequency converter, the rotational speed of the drive and thus of the drum 2 and/or the helical conveyor 3 can be arbitrarily adjusted.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A full-jacket helical conveyor centrifuge, comprising:

a rotatably disposed metallic drum having a horizontal axis rotation and a centrifugal space therein;

a helical conveyor rotatably disposed at a different rotational speed with respect to a rotational speed of the drum, the helical conveyor being rotatable via a gearing by a first drive device or the helical conveyor being rotatable by a second drive device for the drum;

the second drive device for the drum includes at least one electromechanical direct drive;

the at least one electromechanical direct drive includes either primary or secondary elements arranged either directly at or on the drum or arranged at or on a part non-rotatably connected with the drum, and also includes corresponding secondary or corresponding primary elements arranged at a distance with respect to and without contact with the primary and secondary elements, respectively, as well as being arranged outside the drum or the part non-rotatably connected with the drum;

a propulsion force is generated in a gearless manner by an electromagnetic field of travelling waves advancing around the drum or around the part non-rotatably connected with the drum; and the primary or secondary elements being arranged directly on an outer periphery of the drum and at least partially surrounding the centrifugal space.

2. The full-jacket helical conveyor centrifuge according to claim 1, wherein a ratio between an inner axial dimension of the drum and its inside diameter is greater than 1.

3. The full-jacket helical conveyor centrifuge according to claim 2, wherein the ratio is greater than 2.5.

4. The full-jacket helical conveyor centrifuge according to claim 1, wherein the secondary elements of the at least one electromechanical direct drive are arranged on an outer periphery of the drum or on an outer periphery of the part non-rotatably connected with the drum, and the primary elements are arranged radially outside the secondary elements at a distance from the secondary elements and without contact.

5. The full-jacket helical conveyor centrifuge according to claim 1, wherein one or more of the primary and secondary elements surround the drum completely or in sections concentrically and are used for generating the field of travelling waves.

6. The full-jacket helical conveyor centrifuge according to claim 1, wherein the primary or the secondary elements are arranged on a ring disk projecting radially from the drum or on a part non-rotatably connected with the drum, which ring disk is non-rotatably connected with the drum or the part.

7. The full-jacket helical conveyor centrifuge according to claim 1, wherein the second drive device for the drum includes at least one electronic direct drive.

8. The full-jacket helical conveyor centrifuge according to claim 7, wherein the least one electronic drive is arranged on an attachment of the drum as an axial extension of the drum.

9. The full-jacket helical conveyor centrifuge according to claim 1, wherein the primary elements surround the drum in sections and the secondary elements surround the drum completely.

10. The full-jacket helical conveyor centrifuge according to claim 1, wherein the primary elements include a plurality of successively controllable coils distributed on an outer periphery of the drum for generating the field of travelling waves which travel around the drum and take along a plurality of the secondary elements.

11. The full-jacket helical conveyor centrifuge according to claim 10, wherein the secondary elements are permanently magnetic.

12. The full-jacket helical conveyor centrifuge according to claim 1, wherein the drum includes at least one play-free bearing around which or directly adjacent to which at least one electromagnetic direct drive is arranged.

13. The full-jacket helical conveyor centrifuge according to claim 1, wherein the first drive device for the helical conveyor is constructed independently of the second drive device for the drum.

14. The full-jacket helical conveyor centrifuge according to claim 1, wherein the first drive device for the drum is designed as an electromagnetic direct drive.

15. The full-jacket helical conveyor centrifuge according to claim 1, wherein the gearing is not arranged between the drum and the helical conveyor.

16. The full-jacket helical conveyor centrifuge according to claim 1, wherein a rotational speed of one or more of the drum and the helical conveyor can be adjusted continuously.

17. A full-jacket helical conveyer centrifuge, comprising:

a rotatably disposed metallic drum having a horizontal axis rotation;

a helical conveyor rotatably disposed at a different rotational speed with respect to a rotational speed of the drum, the helical conveyor being rotatable via a gearing by a first drive device or the helical conveyor being rotatable by a second drive device for the drum;

the second drive device for the drum includes at least one electromechanical direct drive;

the at least one electromechanical direct drive includes either primary or secondary elements arranged either directly at or on the drum or arranged at or on a part non-rotatably connected with the drum, and also includes corresponding secondary or corresponding primary elements arranged at a distance with respect to and without contact with the primary and secondary elements, respectively, as well as being arranged outside the drum or the part non-rotatably connected with the drum;

a propulsion force is generated in a gearless manner by an electromagnetic field of travelling waves advancing around the drum or around the part non-rotatably connected with the drum;

wherein at least one cylindrical attachment is arranged in an axial direction between main bearings; and wherein the at least one cylindrical attachment is arranged on an outer periphery of a conical section of the drum.

18. A full-jacket helical conveyor centrifuge, comprising:

a rotatably disposed metallic drum having a horizontal axis rotation;

a helical conveyor rotatably disposed at a different rotational speed with respect to a rotational speed of the drum, the helical conveyor being rotatable via a gearing by a first drive device or the helical conveyor being rotatable by a second drive device for the drum;

the second drive device for the drum includes at least one electromechanical direct drive;

the at least one electromechanical direct drive includes either primary or secondary elements arranged either directly at or on the drum or arranged at or on a part non-rotatably connected with the drum, and also includes corresponding or secondary or corresponding primary elements arranged at a distance with respect to and without contact with the primary and secondary elements, respectively, as well as being arranged outside the drum or the part non-rotatably connected with the drum;

a propulsion force is generated in a gearless manner by an electromagnetic field of travelling waves advancing around the drum or around the part non-rotatably connected with the drum;

wherein at least one cylindrical attachment is arranged in an axial direction between main bearings; and wherein the at least one cylindrical attachment is a chamber for receiving a centripetal pump.

19. A full-jacket helical conveyer centrifuge, comprising:

a rotatably disposed metallic drum having a horizontal axis rotation;

a helical conveyor rotatably disposed at a different rotational speed with respect to a rotational speed of the drum, the helical conveyor being rotatable via a gearing by a first drive device or the helical conveyor being rotatable by a second drive device for the drum;

the second drive device for the drum includes at least one electromechanical direct drive;

the at least one electromechanical direct drive includes either primary or secondary elements arranged either directly at or on the drum or arranged at or on a part non-rotatably connected with the drum, and also includes corresponding secondary or corresponding primary elements arranged at a distance with respect to and without contact with the primary and secondary elements, respectively, as well as being arranged outside the drum or the part non-rotatably connected with the drum;

a propulsion force is generated in a gearless manner by an electromagnetic field of travelling waves advancing around the drum or around the part non-rotatably connected with the drum; and a motor generating an additional co-rotating field of travelling waves generates the different rotational speeds between the helical conveyor and the drum.

* * * * *